United States Patent [19]

Rogers et al.

[11] 4,391,871

[45] Jul. 5, 1983

[54] MEAT PACKAGING SHROUD

[75] Inventors: Jack S. Rogers, Spartanburg; Kenneth H. Sanders, Jonesville, both of S.C.

[73] Assignee: Milliken Research Corporation, Spartanburg, S.C.

[21] Appl. No.: 448,306

[22] Filed: Dec. 9, 1982

[51] Int. Cl.[3] ..... B32B 7/00

[52] U.S. Cl. ..... 428/219; 427/359; 427/374.4; 427/434.2; 427/443; 428/220; 428/245; 428/246; 428/252; 428/253; 428/254; 428/297; 428/484

[58] Field of Search ..... 428/245, 257, 253, 254, 428/484, 252, 246, 219, 220, 297; 427/359, 374.4, 434.2, 443, 363

[56] References Cited

U.S. PATENT DOCUMENTS

| | | | |
|---|---|---|---|
| 2,110,410 | 3/1938 | Westby et al. | 99/157 |
| 2,237,277 | 4/1941 | Williams et al. | 99/174 |
| 2,238,546 | 4/1941 | Williams et al. | 99/174 |
| 2,444,443 | 7/1948 | Hesselroth | 154/50 |
| 2,669,396 | 1/1955 | Francis, Jr. | 99/174 |
| 2,682,097 | 6/1954 | Wade | 28/80 |
| 2,697,664 | 12/1954 | Goeser et al. | 99/174 |
| 2,824,011 | 2/1958 | Williams | 99/174 |
| 2,891,870 | 6/1959 | Selby et al. | 99/174 |
| 3,155,123 | 11/1964 | Williams | 139/126 |
| 3,539,435 | 11/1970 | Williams | 161/86 |
| 3,653,927 | 4/1972 | Howell et al. | 99/174 |
| 3,741,260 | 6/1973 | Kocay | 139/420 R |
| 3,783,909 | 1/1974 | Williams | 139/426 |
| 4,101,711 | 7/1978 | Stillman | 428/474 |
| 4,163,070 | 7/1979 | Williams | 426/642 |
| 4,304,813 | 12/1981 | Elmore, Jr. | 428/253 |

*Primary Examiner*—James J. Bell

*Attorney, Agent, or Firm*—Earle R. Marden; H. William Petry

[57] ABSTRACT

A packaging material, preferably for meat, which is composed of a weft inserted, warp knit substrate fabric and a coating of microcrystalline wax on both sides of the substrate fabric.

7 Claims, 3 Drawing Figures

MEAT PACKAGING SHROUD

The use of heat shrinkable plastic as flexible packaging materials for various foodstuffs including meats is a large and growing industry. Such plastic materials, however, have not been satisfactory as flexible packing materials for sharp or bony products. For example, attempts to package bone-in primal cuts of meat have resulted in over 85% bag failures due to bone punctures. The use of cushioning materials such as paper, paper laminates, cloth and various types of plastic have proved unsatisfactory in solving the problem.

The preparation of special cuts or close bone trim with removal of offending bones has also been attempted. However, this is at best only a limited solution to the problem since it does not offer the positive protection necessary for all commercial bone-in types of meat. Furthermore, removal of the bones is a relatively expensive and time-consuming procedure.

It is therefore an object of the invention to provide an economical fabric which can be used to wrap various foodstuffs, such as meat, and is produced in large quantities or rolls from which it can readily be separated but retains its strength in use.

Other objects and advantages of the invention will become readily apparent as the specification proceeds to describe the invention, with reference to the accompanying drawing, in which.

As is well known in the trade, the fabric 10 can be manufactured in wide widths and cut into narrower widths, if desired. The fabric 10 basically consists of a microcrystalline wax 12 coated onto both sides of the substrate fabric 14.

Figure 3:
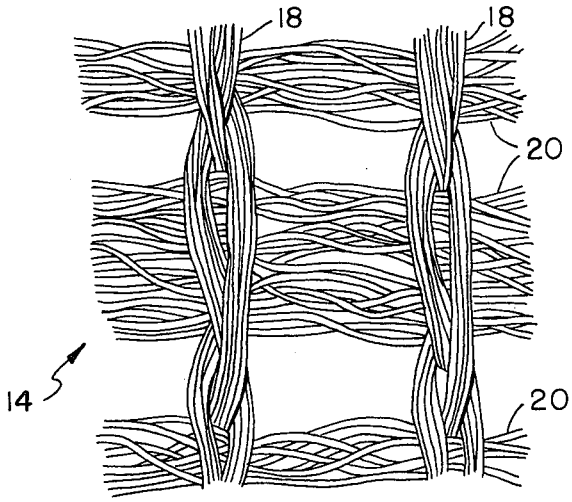
FIG. 3 is a top or loop side view of the substrate fabric of the fabric shown in FIG. 1.

The carrier or substrate fabric 14, illustrated in FIG. 3 is a warp knit, weft insertion fabric with a chain stitch 18 knit, base construction using a 40 denier, continuous filament, polyester yarn while the weft inserted yarn 20 is a 150 denier, textured, polyester continuous filament yarn to provide a 100% synthetic carrier or substrate fabric.

Figure 1:
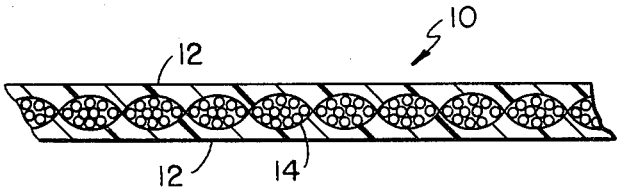
FIG. 1 is a cross-sectional view of new and improved fabric.
Figure 2:
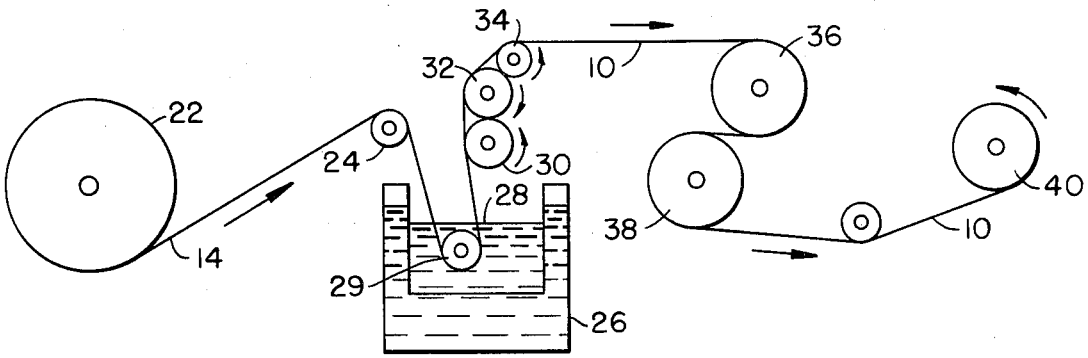
FIG. 2 is a schematic representation of the method of producing the fabric shown in FIG. 1.

The fabric 10 is produced in the manner shown schematically represented in FIG. 2. The carrier or substrate fabric is supplied from a supply roll 22 over an idler roll 24 into a hot wax reservoir 26. From the hot wax bath 28 the substrate 20 via the immersion roll 29, is coated on both sides with wax 12 and delivered over a pair of heated, driven rubber rolls 30 and 32 which remove the excess wax prior to contact with the driven, heated, engraved roll 34 which smooths out the wax on the substrate fabric 10. From the engraved roll 34 the fabric 10 passes over a plurality of chill rolls 36 and 38 to set the wax prior to delivery to the take-up roll 40.

In the preferred form of the invention, the fabric 10 consists of a substrate fabric, as described above, with a weight of 1.04 ounces per square yard coated with a microcrystalline wax layer of 7.7 ounces per square yard to produce the finished fabric 10 which has a total weight of 8.74 ounces per square yard. The microcrystalline wax preferably contains a tackifier to increase the tackiness of the fabric 10.

The resultant fabric made from the above method provides a fabric that is light-weight and, because of the open construction of the carrier or substrate fabric 14, provides a fabric on which the wax is more evenly distributed. Furthermore, as compared to prior art waxed fabrics, the warp knit, weft insertion carrier fabric allows more even distribution of the wax with the application of less wax. Also, the resultant fabric is of lighter gauge and can be readily torn from the supply roll which is very important in the meat processing industry where the employees work in cold rooms under cold conditions where it is necessary to wear gloves. Under such conditions the disclosed fabric can be readily torn and/or cut from a large roll of fabric without extreme difficulty.

Although the specific tape has been described, it is contemplated that changes may be made without departing from the scope or spirit of the invention, and I desire to be limited only by the scope of the claims.

We claim:

1. A fabric particularly useful as a wrapping for foodstuffs, such as meat comprising: a layer of warp knit, weft inserted, synthetic fabric and a layer of wax coated to both sides of said layer, said warp knit fabric having a textured polyester continuous filament weft inserted yarn and a continuous filament chain stitch.

2. The fabric of claim 1 wherein said weft inserted yarn is approximately 150 denier.

3. The fabric of claim 2 wherein said chain stitch yarn is within the range of 40–70 denier.

4. The fabric of claim 1 wherein said fabric has a total weight of less than 10 ounces per square yard.

5. The fabric of claim 4 wherein said weft inserted yarn is approximately 150 denier.

6. The fabric of claim 5 wherein said chain stitch yarn is within the range of 40–70 denier.

7. A method of producing a fabric for foodstuff packaging comprising the steps of: delivering a warp knit, weft inserted continuous filament fabric into a hot bath of microcrystalline wax, taking the wax coated fabric out of the bath and removing the excess wax therefrom, smoothing the surface of the wax on the surface of the fabric, cooling the hot wax on the fabric to set same and taking up the cooled fabric.

* * * * *